US012416114B2

(12) United States Patent
Vadhyar et al.

(10) Patent No.: US 12,416,114 B2
(45) Date of Patent: Sep. 16, 2025

(54) FABRIC SPRAY CONTAINING LACTILOL FOR MALODOUR REDUCTION

(71) Applicant: CONOPCO, INC., Englewood Cliffs, NJ (US)

(72) Inventors: Jayashree Anantharam Vadhyar, Bangalore (IN); Rachana Sankar, Bangalore (IN); Sarmistha Biswas, Bangalore (IN); Srilaxmi Venkata Medepalli, Bangalore (IN)

(73) Assignee: CONIPCO, INC., Englewood Cliffs, NJ (US)

( * ) Notice: Subject to any disclaimer, the term of this patent is extended or adjusted under 35 U.S.C. 154(b) by 536 days.

(21) Appl. No.: 17/781,755

(22) PCT Filed: Nov. 5, 2020

(86) PCT No.: PCT/EP2020/081079
§ 371 (c)(1),
(2) Date: Jun. 2, 2022

(87) PCT Pub. No.: WO2021/110345
PCT Pub. Date: Jun. 10, 2021

(65) Prior Publication Data

US 2023/0023498 A1 Jan. 26, 2023

(30) Foreign Application Priority Data

Dec. 2, 2019 (IN) ..... 201921049539
Jan. 27, 2020 (EP) ..... 20153920

(51) Int. Cl.

| | |
|---|---|
| ***C11D 3/50*** | (2006.01) |
| ***D06M 13/00*** | (2006.01) |
| ***D06M 13/148*** | (2006.01) |
| ***D06M 15/03*** | (2006.01) |
| ***D06M 23/06*** | (2006.01) |

(52) U.S. Cl.
CPC ..... *D06M 13/005* (2013.01); *D06M 13/148* (2013.01); *D06M 15/03* (2013.01); *D06M 23/06* (2013.01)

(58) Field of Classification Search
CPC ... C11D 3/0031; C11D 3/0068; C11D 3/2065; C11D 3/222; C11D 3/50; C11D 7/261; C11D 9/442; C11D 2111/12
See application file for complete search history.

(56) References Cited

U.S. PATENT DOCUMENTS

| | | | | |
|---|---|---|---|---|
| 7,645,746 | B1 | 1/2010 | Trinh et al. | |
| 2006/0089288 | A1* | 4/2006 | Horton, III | C11D 3/2068 510/421 |
| 2010/0285712 | A1 | 11/2010 | Somerville Roberts et al. | |
| 2014/0030304 | A1* | 1/2014 | Koltzenburg | D06M 13/432 514/642 |
| 2014/0044666 | A1 | 2/2014 | Uchiyama et al. | |
| 2017/0107462 | A1* | 4/2017 | Frankenbach | C11D 17/0043 |
| 2017/0245499 | A1* | 8/2017 | Fast | C11D 3/48 |
| 2019/0176176 | A1 | 6/2019 | Roberts et al. | |
| 2020/0297605 | A1* | 9/2020 | Ambrogio | A61Q 19/00 |
| 2022/0304917 | A1* | 9/2022 | Hernandez | A61Q 15/00 |

FOREIGN PATENT DOCUMENTS

| | | | |
|---|---|---|---|
| CN | 103031715 | A | 4/2013 |
| CN | 109789430 | A | 5/2019 |
| EP | 1006993 | A1 | 6/2000 |
| WO | 2018024798 | A1 | 2/2018 |

OTHER PUBLICATIONS

European Search Report and Written Opinion issued in European Patent Application No. EP20153922 dated Jul. 13, 2020.
International Search Report and Written Opinion issued in International Patent Application No. PCT/EP2020/081080 dated Feb. 5, 2021.
Extended European Search Report and Written Opinion issued in corresponding EP Application No. 20153922.8, dated Jul. 13, 2020, pp. 1-5.
International Search Report and Written Opinion issued in corresponding International Application No. PCT/EP2020/081079 dated Jan. 20, 2021, pp. 1-13.
Extended European Search Report and Written Opinion issued in corresponding EP Application No. 20153920.2, dated Jul. 20, 2020, pp. 1-7.

* cited by examiner

*Primary Examiner* — Charles I Boyer
(74) *Attorney, Agent, or Firm* — Carter, DeLuca & Farrell, LLP; George Likourezos; Bret P. Shapiro

(57) ABSTRACT

A malodour reducing spray composition comprising:
a. a prebiotic comprising at least one saccharide unit selected form: galactose, galacturonic, mannuronic, guluronic, glucan, glucose and combinations thereof; and
b. water.

11 Claims, No Drawings

FABRIC SPRAY CONTAINING LACTILOL FOR MALODOUR REDUCTION

CROSS-REFERENCE TO RELATED APPLICATIONS

The application corresponds to PCT/EP2020/081079, filed Nov. 5, 2020, entitled "FABRIC SPRAYS", which claims priority to IN201921049539, filed Dec. 2, 2019 and EP20153920.2, filed Jan. 27, 2020, the entirety of all are incorporated herein by reference.

FIELD OF THE INVENTION

The present invention is concerned with fabric sprays which reduce malodour.

BACKGROUND OF THE INVENTION

Consumers have increasingly busy lives, with limited time to do their laundry. On the other hand, roughly 40% of garments which go through the laundry process are not dirty and could be re-worn. This practice of over washing leads to un-necessary use of water which can be problematic particularly in water scarce regions of the world.

Various fabric re-fresh sprays have been disclosed previously. Such sprays commonly contain perfumes and/or anti-wrinkle ingredients. However there remains a need for a product which effectively reduces malodours and prevents the formation of further malodours, thereby providing consumers with the confidence to re-wear garments.

SUMMARY OF THE INVENTION

In a first aspect of the present invention is provided a malodour reducing spray composition comprising:

a. a prebiotic comprising at least one saccharide unit selected form: galactose, galacturonic, mannuronic, guluronic, glucan, glucose and combinations thereof; and b. water.

In a second aspect of the present invention is provided a method of malodour reduction, wherein a fabric is sprayed with a composition comprising:

a. a prebiotic comprising at least one saccharide unit selected form: galacturonic, mannuronic, guluronic, glucan, glucose and combinations thereof; and b. water.

In third aspect of the present invention is provided a method of preventing malodours from developing on a fabric surface, wherein a fabric is sprayed with a composition comprising:

a. a prebiotic comprising at least one saccharide unit selected form: galactose, galacturonic, mannuronic, guluronic, glucan, glucose and combinations thereof; and b. water.

In a fourth aspect of the present invention is provided a use of a spray comprising a prebiotic comprising at least one saccharide unit selected form: galactose, galacturonic, mannuronic, guluronic, glucan, glucose and combinations thereof, to reduce malodour on worn clothes and/or to reduce the development of malodours on worn clothes.

DETAILED DESCRIPTION OF THE INVENTION

These and other aspects, features and advantages will become apparent to those of ordinary skill in the art from a reading of the following detailed description and the appended claims. For the avoidance of doubt, any feature of one aspect of the present invention may be utilised in any other aspect of the invention. The word "comprising" is intended to mean "including" but not necessarily "consisting of" or "composed of." In other words, the listed steps or options need not be exhaustive. It is noted that the examples given in the description below are intended to clarify the invention and are not intended to limit the invention to those examples per se. Similarly, all percentages are weight/weight percentages unless otherwise indicated. Except in the operating and comparative examples, or where otherwise explicitly indicated, all numbers in this description indicating amounts of material or conditions of reaction, physical properties of materials and/or use are to be understood as modified by the word "about". Numerical ranges expressed in the format "from x to y" are understood to include x and y. When for a specific feature multiple preferred ranges are described in the format "from x to y", it is understood that all ranges combining the different endpoints are also contemplated.

Aqueous Composition

The compositions of the present invention are aqueous fabric sprays. Preferably at least 60 wt. % of the composition is water, more preferably at least 70 wt. %.

Prebiotic

The spray compositions of the present invention comprise a prebiotic, the prebiotics of the present invention comprise at least one saccharide unit selected form: galactose, galacturonic, mannuronic, guluronic, glucan, glucose and combinations thereof.

Prebiotics are substances that selectively stimulate the growth and/or activity of one or more microbes. In the context of the present invention, prebiotics immediately reduce any malodours present on worn clothes and prevent further malodours from developing on the worn clothes, i.e. after a garment has been worn for a day, application of a prebiotic from a spray composition significantly reduces the development of malodours. In particular, the development of underarm malodour, development of a dank malodour, a "wet-clothes" smell, hydrogen sulphide and similar malodours are inhibited.

Preferably, the composition comprises prebiotic at a level selected from: less than 4%, less than 3%, and less than 2%, by weight of the spray composition. Prebiotic may be present at a level selected from: more than 0.1%, more than 0.2%, and more than 0.25%, by weight of the spray composition. Suitably prebiotic is present in the spray composition in an amount selected from the range of from about 0.1% to about 4%, preferably from about 0.2% to about 3%, more preferably from about 0.25% to about 2%, by weight of the spray composition.

Preferably the prebiotic comprises at least one saccharide unit selected form: galactose, galacturonic, mannuronic, guluronic, glucan and combinations thereof. More preferably the prebiotic comprises at least one saccharide unit selected form: galactose, galacturonic and guluronic.

Examples of suitable prebiotics include: pectin (Galacturonic acid polymer), Lactitol (4-O-α-D-Galactopyranosyl-D-glucitol), algin (a homopolymer of (1-4)-linked β-D-mannuronate and its α-L-guluronate).

Perfume

The spray compositions of the present invention preferably comprise perfume. It is understood that the presence of a prebiotic material enhances the perfume composition in a spray. In compositions comprising perfume and a prebiotic, the consumer experiences an enhanced fragrance experience. This may be characterised by a stronger perfume intensity.

Free perfume may be present at a level selected from: less than 10%, less than 8%, and less than 5%, by weight of the spray composition. Free perfume may be present at a level selected from: more than 0.0001%, more than 0.001%, and more than 0.01%, by weight of the spray composition. Suitably free perfume is present in the spray composition in an amount selected from the range of from about 0.0001% to about 10%, preferably from about 0.001% to about 8%, more preferably from about 0.01% to about 5%, by weight of the spray composition.

Useful perfume components may include materials of both natural and synthetic origin. They include single compounds and mixtures. Specific examples of such components may be found in the current literature, e.g., in Fenaroli's Handbook of Flavor Ingredients, 1975, CRC Press; Synthetic Food Adjuncts, 1947 by M. B. Jacobs, edited by Van Nostrand; or Perfume and Flavor Chemicals by S. Arctander 1969, Montclair, N.J. (USA). These substances are well known to the person skilled in the art of perfuming, flavouring, and/or aromatizing consumer products.

A wide variety of chemicals are known for perfume use including materials such as aldehydes, ketones, esters and the like. More commonly, naturally occurring plant and animal oils and exudates comprising complex mixtures of various chemical components are known for use as perfume, and such materials can be used herein. Typical perfumes can comprise e.g. woody/earthy bases containing exotic materials such as sandalwood oil, civet and patchouli oil. The perfume also can be of a light floral fragrance e.g. rose or violet extract. Further the perfume can be formulated to provide desirable fruity odours e.g. lime, lemon or orange. Preferably the perfume composition of the present invention comprises at least 50 wt. % naturally occurring oils, more preferably at least 80 wt. % of the perfume composition is naturally occurring oils.

Particular examples of useful perfume components and compositions are anetole, benzaldehyde, benzyl acetate, benzyl alcohol, benzyl formate, iso-bornyl acetate, camphene, cis-citral (neral), citronellal, citronellol, citronellyl acetate, paracymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, myrcene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, vertenex (para-tertiary-butyl cyclohexyl acetate), amyl cinnamic aldehyde, isoamyl salicylate, beta-caryophyllene, cedrene, cinnamic alcohol, couramin, dimethyl benzyl carbinyl acetate, ethyl vanillin, eugenol, iso-eugenol, flor acetate, heliotrophine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, veratraldehyde, alpha-cedrene, beta-cedrene, C15H24sesquiterpenes, benzophenone, benzyl salicylate, ethylene brassylate, galaxolide (1,3,4,6,7,8-hexahydro-4,6,6,7,8,8,-hexamethyl-cyclo-penta-gamma-2-benzopyran), hexyl cinnamic aldehyde, lyral (4-(4-hydroxy-4-methyl pentyl)-3-cyclohexene-10-carboxaldehyde), methyl cedrylone, methyl dihydro jasmonate, methyl-beta-naphthyl ketone, musk ambrette, musk idanone, musk ketone, musk tibetine, musk xylol, aurantiol and phenylethyl phenyl acetate.

The free perfume compositions of the present compositions comprise blooming perfume ingredients. Blooming perfume components are defined by a boiling point less than 250° C. and a Log P or greater than 2.5. Preferably the free perfume compositions of the present invention comprise at least 10 wt. % blooming perfume ingredients, more preferably at least 20 wt. % blooming perfume ingredients, most preferably at least 25 wt. % blooming perfume ingredients. Preferably the free perfume compositions of the present comprise less than 58 wt. % blooming perfume ingredients, more preferably less than 50 wt. % blooming perfume ingredients, most preferably less than 45 wt. % blooming perfume ingredients. Suitably the free perfume compositions of the present compositions comprise 10 to 58 wt. % blooming perfume ingredients, preferably 20 to 50 wt. % blooming perfume ingredients, more preferably 25 to 45 wt. % blooming perfume ingredients.

Examples of suitable blooming perfume ingredient include: Allo-ocimene, Allyl heptanoate, trans-Anethole, Benzyl butyrate, Camphene, Carvacrol, cis-3-Hexenyl tiglate, Citronellol, Citronellyl acetate, Citronellyl nitrile, Cyclohexylethyl acetate, Decyl Aldehyde (Capraldehyde), Dihydromyrcenol, Dihydromyrcenyl acetate, 3,7-Dimethyl-1-octanol, Fenchyl Acetate, Geranyl acetate, Geranyl formate, Geranyl nitrile, cis-3-Hexenyl isobutyrate, Hexyl Neopentanoate, Hexyl tiglate, alpha-Ionone, Isobornyl acetate, Isobutyl benzoate, Isononyl acetate, Isononyl alcohol, Isopulegyl acetate, Lauraldehyde, Linalyl acetate, Lorysia, D-limonene, Lymolene, (−)-L-Menthyl acetate, Methyl Chavicol (Estragole), Methyl n-nonly acetaldehyde, Methyl octyl acetaldehyde, Beta-Myrcene, Neryl acetate, Nonyl acetate, Nonaldehyde, Para-Cymene, alpha-Pinene, beta-Pinene, alpha-Terpinene, gamma-Terpinene, Terpineolene, alpha-Terpinyl acetate, Tetrahydrolinalool, Tetrahydromyrcenol, 2-Undecenal, Verdox (o-t-Butylcyclohexyl acetate), and Vertenex(4-tert.Butylcyclohexyl acetate).

Other useful perfume ingredients include substantive perfume components. Substantive perfume components are defined by a boiling point greater than 250° C. and a Log P greater than 2.5. Preferably the free perfume composition further comprises substantive perfume ingredients.

Boiling point is measured at standard pressure (760 mm Hg). Preferably a perfume composition will comprise a mixture of blooming and substantive perfume components. The perfume composition may comprise other perfume components.

The log P of many perfume ingredients have been reported; for example, the Pomona92 database, available from Daylight Chemical Information Systems, Inc. (Daylight CIS), Irvine, Calif., contains many, along with citations to the original literature. However, the log P values are most conveniently calculated by the "C LOG P" program, also available from Daylight CIS. This program also lists experimental log P values when they are available in the Pomona92 database. The "calculated log p" (C log P) is determined by the fragment approach of Hansch and Leo (cf., A Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The C log P values, which are the most reliable and widely used estimates for this physicochemical property, are used instead of the experimental log P values in the selection of perfume ingredients herein.

It is commonplace for a plurality of perfume components to be present in a free oil perfume composition. In the compositions for use in the present invention it is envisaged that there will be three or more, preferably four or more, more preferably five or more, most preferably six or more different perfume components. An upper limit of 300 perfume components may be applied.

The free perfume of the present invention is in the form of an emulsion. The particle size of the emulsion can be in the range from about 1 nm to 30 microns and preferably from about 100 nm to about 20 microns. The particle size is measured as a volume mean diameter, D[4,3], this can be measured using a Malvern Mastersizer 2000 from Malvern instruments.

Without wishing to be bound by theory, it is believed that the free perfumes of this emulsion particle size will interact with polymers in the present invention to provide improved perfume longevity on the items being sprayed.

The compositions of the present invention may further comprise perfume microcapsules.

The compositions of the present invention may preferably comprises 0.1 to 5 wt. % perfume microcapsules, more preferably 0.5 to 2 wt. % perfume microcapsules. The weight of microcapsules is of the material as supplied.

When perfume components are encapsulated, suitable encapsulating materials, may comprise, but are not limited to; aminoplasts, proteins, polyurethanes, polyacrylates, polymethacrylates, polysaccharides, polyamides, polyolefins, gums, silicones, lipids, modified cellulose, polyphosphate, polystyrene, polyesters or combinations thereof. Particularly preferred materials are aminoplast microcapsules, such as melamine formaldehyde or urea formaldehyde microcapsules.

Perfume microcapsules of the present invention can be friable microcapsules and/or moisture activated microcapsules. By friable, it is meant that the perfume microcapsule will rupture when a force is exerted. By moisture activated, it is meant that the perfume is released in the presence of water. The compositions of the present invention preferably comprise friable microcapsules. Moisture activated microcapsules may additionally be present. Examples of a microcapsules which can be friable include aminoplast microcapsules.

Perfume components contained in a microcapsule may comprise odiferous materials and/or pro-fragrance materials.

Particularly preferred perfume components contained in a microcapsule are blooming perfume components and substantive perfume components. Blooming perfume components are defined by a boiling point less than 250° C. and a Log P greater than 2.5. Preferably the encapsulated perfume compositions comprise at least 20 wt. % blooming perfume ingredients, more preferably at least 30 wt. % and most preferably at least 40 wt. % blooming perfume ingredients. Substantive perfume components are defined by a boiling point greater than 250° C. and a Log P greater than 2.5. Preferably the encapsulated perfume compositions comprise at least 10 wt. % substantive perfume ingredients, more preferably at least 20 wt. % and most preferably at least 30 wt. % substantive perfume ingredients. Boiling point is measured at standard pressure (760 mm Hg). Preferably a perfume composition will comprise a mixture of blooming and substantive perfume components. The perfume composition may comprise other perfume components.

It is commonplace for a plurality of perfume components to be present in a microcapsule. In the compositions for use in the present invention it is envisaged that there will be three or more, preferably four or more, more preferably five or more, most preferably six or more different perfume components in a microcapsule. An upper limit of 300 perfume components may be applied.

The microcapsules may comprise perfume components and a carrier for the perfume ingredients, such as zeolites or cyclodextrins.

Emollient

The spray compositions of the present invention preferably comprise an emollient or combinations thereof. The term emollient refers to materials that are able to soften surfaces (especially skin and hair). It is believed that the emollient enhances the prebiotic malodour performance.

Preferably the spray comprises less than 15 wt. % emollient, less than 10 wt. % emollient, and less than 5 wt. % emollient, by weight of the spray composition. Preferably the spray comprises more than 0.1 wt. % emollient, more than 0.5 wt. % emollient, and more than 1 wt. % emollient, by weight of the spray composition. Suitably emollient is present in the spray composition in an amount selected from the range of from about 0.1% to about 15%, preferably from about 0.5% to about 10%, more preferably from about 1% to about 5%, by weight of the spray composition.

An emollient is generally an emulsion formed from an oil and water. The emulsion may be formed in situ, however, is preferably formed prior to addition to the spray composition. The emollient may be formed from plant oils (including fruit oils) or mineral oils. Plant oils are preferred. Preferably the emollient has a chain length of C12 to C22.

Preferably the emollient has a spreading value of greater than 800 $mm^2$ per 10 minutes preferably 1000 to 1500 $mm^2$ per 10 minutes. The measurement of spreading values ($mm^2$/10 min) are carried out by applying 20 μl of an emollient in the middle of an ash-less, medium to fast filter paper at 25° C. The time between application and measurement of spreading area is exactly 10 minutes.

Suitable emollients include Dicaprylyl ether available under the trade name Cetiol OE ex BASF and Hydrogenated Ethylhexyl Olivate and Hydrogenated Olive Oil Unsaponifiables under the trade name Plantasens Olive LD ex Clarient.

Emulsifier

The spray compositions of the present invention preferably comprise an emulsifier or combinations thereof.

Preferably the spray comprises less than 15 wt. % emulsifier, less than 10 wt. % emulsifier, and less than 6 wt. % emulsifier, by weight of the spray composition. Preferably the spray comprises more than 0.5 wt. % emulsifier, more than 1 wt. % emulsifier, and more than 2 wt. % emulsifier, by weight of the spray composition. Suitably emulsifier is present in the spray composition in an amount selected from the range of from about 0.5% to about 15%, preferably from about 1% to about 10%, more preferably from about 2% to about 6%, by weight of the spray composition. The correct amount of emulsifier is important can be important for achieving the desired malodour effect.

The emulsifier may be anionic, cationic, non-ionic or amphoteric. Preferably the emulsifier in non-ionic.

The emulsifier will preferably have an HLB value of 3 to 20, more preferably 3 to 18. Examples of emulsifier materials include: ethoxylated materials, polyols such as polyhydric alcohols and polyol esters, alkyl polyglucosides, EO-PO block copolymers (Poloxamers). Preferably, the emulsifier is selected from ethoxylated materials. Preferred ethoxylated materials include: fatty acid ethoxylates, fatty amine ethoxylates, fatty alcohol ethoxylates, nonylphenol ethoxylates, alkyl phenol ethoxylate, amide ethoxylates, Sorbitan(ol) ester ethoxylates, glyceride ethoxylates (castor oil or hydrogenated castor oil ethoxylates) and mixtures thereof.

More preferably, the emulsifier is selected from ethoxylated surfactants having a general formula:

$$R_1O(R_2O)_xH$$

$R_1$=hydrophobic moiety.

$R_2$=$C_2H_4$ or mixture of $C_2H_4$ and $C_3H_6$ units x=4 to 120

R1 preferably comprises 8 to 25 carbon atoms and mixtures thereof, more preferably 10 to 20 carbon atoms and mixtures thereof most preferably 12 to 18 carbon atoms and mixtures thereof. Preferably, R is selected from the group consisting of primary, secondary and branched chain saturated and/or unsaturated hydrocarbon groups comprising an alcohol, carboxy or phenolic group. Preferably R is a natural or synthetic alcohol.

R2 preferably comprises at least 50% C2H4, more preferably 75% C2H4, most preferably R2 is C2H4.

x is preferably 8 to 90 and most preferably 10 to 60.

Examples of commercially available, suitable emulsifier include: Genapol C200 ex. Clariant and Eumulgin C040 ex. BASF.

Polymer

The fabric spray of the present invention preferably comprises one or more polymers. The polymers may have properties of film-formation, adhesion, or provide a coating on a surface on which the polymer is applied.

The correct level of polymer is required to ensure that the polymer is present in sufficient quantities to provide the benefit, but not so high that it causes blockage of the nozzle of the spray device from which they are sprayed.

The polymer may be present at a level selected from: less than 1.5%, less than 1%, less than 0.5%, less than 0.45%, and less than 0.4%, by weight of the spray composition. The polymer may be present at a level selected from: more than 0.01%, more than 0.05%, and more than 0.1%, by weight of the spray composition. Suitably the polymer is present in the spray composition in an amount selected from the range of from about 0.01% to about 1.5%, about 0.01 to about 1%, about 0.01 to about 0.5%, preferably from about 0.05% to about 0.45%, more preferably from about 0.1% to about 0.4%, by weight of the fabric spray composition.

The molecular weight of the polymer is preferably from 100 to 500,000, more preferably from 1,000 to 250,000 even more preferably from 2,500 to 200,000.

The polymer according to the present invention may be any water-soluble or water dispersible polymer. Preferably the polymer is a film-forming polymer or mixture of such polymers. This includes homopolymers or copolymers. The polymers may be of natural or synthetic origin, preferably natural. Natural polymers are polymers which occur in nature or are extracted from plants or animals, this includes polymers produced by microorganisms in a bioreactor.

Functionality rendering the polymers water-soluble may be selected from hydroxyl, amine, amide or carboxyl groups or mixtures thereof.

The polymers may be cationic, anionic, non-ionic or amphoteric. The polymers make be a single species of polymer or a mixture thereof. For all polymers herein described, it is intended to cover both the acids and salts thereof.

Suitable cationic polymers are preferably selected from the group consisting of: quaternized acrylates or methacrylates, quaternary homopolymers or copolymers of vinylimidazole, homopolymers or copolymers comprising a quaternary dimethdiallyl ammonium chloride, cationic polysaccharides, polypeptides and mixtures thereof.

Preferably a cationic polymer is selected from cationic polysaccharides or polypeptides. Suitable cationic polypeptides are selected from: cationic cellulose, cationic starches, cationic glycogens, cationic chitins, cationic guar gums and mixtures thereof. Derivatives of cationic celluloses, cationic starches, cationic glycogens, cationic chitins and cationic guar gums are also preferred. More preferably are cationic cellulose, cationic cellulose derivatives, cationic chitosans, cation chitosan derivatives and mixtures thereof.

Cationic cellulose derivatives are preferably selected from: a copolymers of cellulose derivatives such as hydroxyalkylcelluloses (e.g. hydroxymethyl-, hydroxyethyl- or hydroxypropylcelluloses) grafted with a water-soluble monomer comprising a quaternary ammonium (e.g. glycidytrimethyl ammonium, methacryloyloxyethyltrimethylammonium, or a methacrylamidopropyltrimethylammonium, or dimethyldiallylammonium salt) and mixtures thereof. For example, such as hydroxyethylcellulose dimethyldiallyammonium chloride [PQ4] sold as Celquat L200 by Akzo Nobel, or such as Quaternized hydroxyethylcellulose [PQ10] sold as UCARE JR125 by Dow Personal Care. Chitosans and derivatives thereof are preferably selected from: chitosan and salts of chitosans. The salts can be chitosan acetate, lactate, glutamate, gluconate or pyrrolidinecarboxylate preferably with a degree of hydrolysis of at least 80%; and mixtures thereof. A suitable chitosan includes Hydagen HCMF by Cognis.

Suitable anionic polymers may be selected from anionic polysaccharides, water-soluble polyurethane or polymers comprising groups derived from carboxylic or sulfonic acids. Copolymers containing acid units are generally used in their partially or totally neutralized form, more preferably totally neutralized. Suitable anionic polymer may comprise:

a) at least one monomer derived from a carboxylic acid or C4-C8 monounsaturated polycarboxylic acids or anhydrides, or sulfonic acid; and b) one or more monomers selected from the group consisting of: esters of acrylic acid and/or methacrylic acid; acrylate esters grafted onto a polyalkylene glycol such as polyethylene glycol; hydroxyesters acrylate;
acrylamides, methacrylamides which may or may not be substituted on the nitrogen by lower alkyl groups (C1-C4); N-alkylated
acrylamide; hydroxyalkylated acrylamide; amino alkylated
acrylamide; alkylacrylamine; alkylether acrylate; monoethylenic monomer such as ethylene, styrene; vinyl esters; vinyl esters grafted onto a polyalkylene glycol such as polyethylene glycol; vinyl ether; vinyl halides; phenylvinyl derivatives; allyl esters or methallyl esters; vinyllactams such as vinylpyrrolidone
or vinylcapro lactam; alkyl maleimide, hydroxyalkyl maleimide; and mixtures thereof. When present the anhydride functions of these polymers can optionally be monoesterified or monoamidated.

Preferably the anionic polymer may be selected from anionic polysaccharides or polypeptides. Anionic polysaccharides are preferably selected from: anionic celluloses, anionic starches, anionic glycogens, anionic chitins, anionic guar gums, and mixtures thereof. Derivatives of anionic celluloses, anionic starches, anionic glycogens, anionic chitins and anionic guar gums are also preferred.

Suitable non-ionic polymers may be selected from: non-ionic polysaccharides or homopolymers and copolymers comprising:

a) at least one of the following main monomers: vinylpyrrolidone, vinyl esters grafted onto a polyalkylene glycol such as polyethylene glycol, acrylate esters grafted onto a polyalkylene glycol such as polyethylene glycol or acrylamide and b) one or more other monomers such as vinyl esters, alkylacrylamine, vinylcaprolactam, hydroxyalkylated acrylamide, amino alkylated acrylamide, vinyl ether, alkyl maleimide, hydroxyalkyl maleimide, and mixtures thereof.

Preferably a non-ionic polymer is a non-ionic polysaccharide or polypeptide. A polysaccharide is preferably selected from: non-ionic cellulose, non-ionic starches, non-ionic glycogens, non-ionic chitins, non-ioinc guar gums and mixtures thereof. Derivatives of non-ionic starches, non-ionic glycogens, non-ionic chitins and non-ioinc guar gums are also preferred, for example hydroxyalkylcelluloses.

Suitable amphoteric polymers include those comprising: an acid and a base like monomer, a carboxybetaine or sulfobetaine zwitterionic monomer, and an alkylamine oxide acrylate monomer.

Suitable amphoteric polymers comprising acid and base monomers maybe selected from:

a) at least one monomer containing a basic nitrogen atom;

b) at least one acid monomer comprising one or more carboxylic or sulfonic groups; and c) one or more monomers selected from acrylamides, methacrylamides which may or may not be substituted on the nitrogen by lower alkyl groups (C1-C4), vinyllactams such as vinylpyrrolidone or vinylcapro lactam, esters of acrylic acid and/or methacrylic acid, acrylate esters grafted onto a polyalkylene glycol such as polyethylene glycol, hydroxyesters acrylate, hydroxyalkylated acrylamide, amino alkylated, alkylacrylamine, alkylether acrylate, monoethylenic monomer such as ethylene, styrene, vinyl esters, vinyl ether, vinyl halides, phenylvinyl derivatives, allyl esters or methallyl esters, and mixtures thereof.

Suitable amphoteric polymers comprising carboxybetaine or sulfobetaine zwitterionic monomer maybe selected from:

a) at least one carboxybetaine or sulfobetaine zwitterioni monomer; and b) one or more monomers selected from acrylamides, methacrylamides which may or may not be substituted on the nitrogen by lower alkyl groups (C1-C4), vinyllactams such as vinylpyrrolidone or vinylcapro lactam, esters of acrylic acid and/or methacrylic acid, acrylate esters grafted onto a polyalkylene glycol such as polyethylene glycol, hydroxyesters acrylate, hydroxyalkylated acrylamide, amino alkylated, alkylacrylamine, alkylether acrylate, monoethylenic monomer such as ethylene, styrene, vinyl esters, vinyl ether, vinyl halides, phenylvinyl derivatives, allyl esters or methallyl esters, and mixtures thereof.

Suitable amphoteric polymers comprising alkylamine oxide acrylate are preferably selected from:

a) an ethylamine oxide methacrylate; and b) one or more monomers selected from acrylamides, methacrylamides which may or may not be substituted on the nitrogen by lower alkyl groups (C1-C4), vinyllactams such as vinylpyrrolidone or vinylcapro lactam, esters of acrylic acid and/or methacrylic acid, acrylate esters grafted onto a polyalkylene glycol such as polyethylene glycol, hydroxyesters acrylate, hydroxyalkylated acrylamide, amino alkylated, alkylacrylamine, alkylether acrylate, monoethylenic monomer such as ethylene, styrene, vinyl esters, vinyl ether, vinyl halides, phenylvinyl derivatives, allyl esters or methallyl esters, and mixtures thereof.

Preferably the amphoteric polymer may be selected from amphoteric polysaccharides or polypeptides. Amphoteric polysaccharides are preferably selected from: amphoteric celluloses, amphoteric starches, amphoteric glycogens, amphoteric chitins, amphoteric guar gums, and mixtures thereof. Derivatives of amphoteric celluloses, amphoteric starches, amphoteric glycogens, amphoteric chitins and amphoteric guar gums are also preferred.

More generally, the polymer of the present invention is preferably a naturally derived polymer. The polymer is preferably an anionic, cationic, non-ionic or amphoteric polysaccharide or polypeptide. A polysaccharide is preferably selected from celluloses, starches, glycogens, chitins, guar gums, and mixtures thereof. Derivatives of celluloses, starches, glycogens, chitins and guar gums are also preferred. Most preferably the polymer is selected form hydroxymethyl cellulose or starch-based polymers.

Softening Agent:

The spray compositions of the present invention preferably comprise a softening agent. The softening agent may be a silicone based softening agent or a non-silicone based softening agent. Non-silicone softening agents are preferred. It is understood that the softening agent improves the efficacy of the prebiotic.

Softening agents may be present at a level selected from: less than 10%, less than 8%, and less than 6%, by weight of the spray composition. Softening agents may be present at a level selected from: more than 0.5%, more than 1%, and more than 1.5%, by weight of the spray composition. Suitably softening agents are present in the spray composition in an amount selected from the range of from about 0.5% to about 10%, preferably from about 1% to about 8%, more preferably from about 1.5% to about 6%, by weight of the spray composition.

Suitable examples of non-silicone based softening agents include fabric softening quaternary ammonium compounds, amines, fatty acid esters, fatty ethers, clays, waxes, polyolefins, sugar polyesters, polymer latexes, synthetic and natural oils. Preferred softening agents are fatty esters, fatty ether and quaternary ammonium compounds, particularly preferred are quaternary ammonium compounds.

Fatty esters that may be employed include fatty monoesters, such as glycerol monostearate and fatty sugar esters, such as those disclosed WO 01/46361 (Unilever). Examples of suitable esters include: Coco-caprylate, hydrogenated ethyl hexyl olivate, Lauryl/Myristyl polyricinoleate. Fatty monoesters are preferred. Preferably the fatty esters comprise 12 to 40 carbon atoms.

Fatty ethers preferably comprise fatty monoethers, such as dicaprylyl ether. Preferably the fatty ethers comprise 12 to 40 carbon atoms.

For the purposes of the present invention, fabric softening quaternary ammonium compounds are so called "ester quats". Particularly preferred materials are the ester-linked triethanolamine (TEA) quaternary ammonium compounds comprising a mixture of mono-, di- and tri-ester linked components. Typically, TEA-based fabric softening compounds comprise a mixture of mono, di- and tri ester forms of the compound where the di-ester linked component comprises no more than 70 wt. % of the fabric softening compound, preferably no more than 60 wt. % e.g. no more than 55%, or even no more that 45% of the fabric softening compound and at least 10 wt. % of the monoester linked component.

Typically, TEA-based fabric softening compounds comprise a mixture of mono, di- and tri ester forms of the compound where the di-ester linked component comprises no more than 70 wt. % of the fabric softening compound, preferably no more than 60 wt. % e.g. no more than 55%, or even no more that 45% of the fabric softening compound and at least 10 wt. % of the monoester linked component.

Preferably fabric softening quaternary ammonium compounds comprise at least one chain derived from fatty acids, more preferably at least two chains derived from a fatty acids. Generally fatty acids are defined as aliphatic monocarboxylic acids having a chain of 4 to 28 carbons. Preferably the fatty acid chains are palm or tallow fatty acids. Preferably the fatty acid chains of the QAC comprise from 10 to 50 wt. % of saturated C18 chains and from 5 to 40 wt. % of monounsaturated C18 chains by weight of total fatty acid chains. In a further preferred embodiment, the fatty acid chains of the QAC comprise from 20 to 40 wt. %, preferably from 25 to 35 wt. % of saturated C18 chains and from 10 to 35 wt. %, preferably from 15 to 30 wt. % of monounsaturated C18 chains, by weight of total fatty acid chains.

A first group of quaternary ammonium compounds (QACs) suitable for use in the present invention is represented by formula (1):

$$R^1-N^+(-[(CH_2)_n(TR)]_m)-[(CH_2)_n(OH)]_{3-m}X^- \quad (I)$$

wherein each R is independently selected from a C5 to C35 alkyl or alkenyl group; R1 represents a C1 to C4 alkyl, C2 to C4 alkenyl or a C1 to C4 hydroxyalkyl group; T may be either O—CO. (i.e. an ester group bound to R via its carbon atom), or may alternatively be CO—O (i.e. an ester group bound to R via its oxygen atom); n is a number selected from 1 to 4; m is a number selected from 1, 2, or 3; and $X^-$ is an anionic counter-ion, such as a halide or alkyl sulphate, e.g. chloride or methylsulfate. Di-esters variants of formula I (i.e. m=2) are preferred and typically have mono- and tri-ester analogues associated with them. Such materials are particularly suitable for use in the present invention.

Suitable actives include soft quaternary ammonium actives such as Stepantex VT90, Rewoquat WE18 (ex-Evonik) and Tetranyl L1/90N, Tetranyl L190 SP and Tetranyl L190 S (all ex-Kao).

Also suitable are actives rich in the di-esters of triethanolammonium methylsulfate, otherwise referred to as "TEA ester quats".

Commercial examples include Praepagen™ TQ (ex-Clariant), and Tetranyl™ AHT-1 (ex-Kao), (both di-[hardened tallow ester] of triethanolammonium methylsulfate), AT-1 (di-[tallow ester] of triethanolammonium methylsulfate), and L5/90 (di-[palm ester] of triethanolammonium methylsulfate), (both ex-Kao), and Rewoquat™ WE15 (a di-ester of triethanolammonium methylsulfate having fatty acyl residues deriving from C10-C20 and C16-C18 unsaturated fatty acids) (ex-Evonik).

A second group of QACs suitable for use in the invention is represented by formula (II):

$$(R^1)_3N^+-(CH_2)_n-CH(CH_2TR^2)-TR^2X^- \quad (II)$$

wherein each R1 group is independently selected from C1 to C4 alkyl, hydroxyalkyl or C2 to C4 alkenyl groups; and wherein each R2 group is independently selected from C8 to C28 alkyl or alkenyl groups; and wherein n, T, and $X^-$ are as defined above.

Preferred materials of this second group include 1,2 bis[tallowoyloxy]-3-trimethylammonium propane chloride, 1,2 bis[hardened tallowoyloxy]-3-trimethylammonium propane chloride, 1,2-bis[oleoyloxy]-3-trimethylammonium propane chloride, and 1,2 bis[stearoyloxy]-3-trimethylammonium propane chloride. Such materials are described in U.S. Pat. No. 4,137,180 (Lever Brothers). Preferably, these materials also comprise an amount of the corresponding mono-ester.

A third group of QACs suitable for use in the invention is represented by formula (III):

$$(R^1)_2-N^+-[(CH_2)_n-T-R^2]_2X^- \quad (III)$$

wherein each R1 group is independently selected from 01 to 04 alkyl, or 02 to 04 alkenyl groups; and wherein each R2 group is independently selected from 08 to 028 alkyl or alkenyl groups; and n, T, and $X^-$ are as defined above. Preferred materials of this third group include bis(2-tallowoyloxyethyl)dimethyl ammonium chloride, partially hardened and hardened versions thereof.

A particular example of the fourth group of QACs is represented the by the formula:

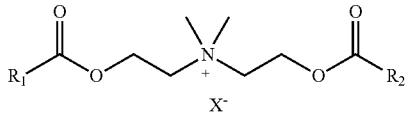

A fourth group of QACs suitable for use in the invention are represented by formula (V)

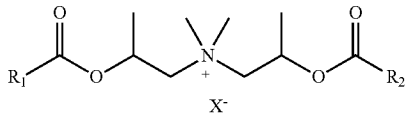

R1 and R2 are independently selected from C10 to C22 alkyl or alkenyl groups, preferably C14 to C20 alkyl or alkenyl groups. $X^-$ is as defined above.

The iodine value of the quaternary ammonium fabric conditioning material is preferably from 0 to 80, more preferably from 0 to 60, and most preferably from 0 to 45. The iodine value may be chosen as appropriate. Essentially saturated material having an iodine value of from 0 to 5, preferably from 0 to 1 may be used in the compositions of the invention. Such materials are known as "hardened" quaternary ammonium compounds.

A further preferred range of iodine values is from 20 to 60, preferably 25 to 50, more preferably from 30 to 45. A material of this type is a "soft" triethanolamine quaternary ammonium compound, preferably triethanolamine di-alkylester methylsulfate. Such ester-linked triethanolamine quaternary ammonium compounds comprise unsaturated fatty chains.

If there is a mixture of quaternary ammonium materials present in the composition, the iodine value, referred to above, represents the mean iodine value of the parent fatty acyl compounds or fatty acids of all of the quaternary ammonium materials present. Likewise, if there is any saturated quaternary ammonium materials present in the composition, the iodine value represents the mean iodine value of the parent acyl compounds of fatty acids of all of the quaternary ammonium materials present.

Iodine value as used in the context of the present invention refers to, the fatty acid used to produce the QAC, the measurement of the degree of unsaturation present in a material by a method of nmr spectroscopy as described in Anal. Chem., 34, 1136 (1962) Johnson and Shoolery.

A further type of softening compound may be a non-ester quaternary ammonium material represented by formula (VI):

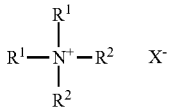

wherein each R1 group is independently selected from C1 to C4 alkyl, hydroxyalkyl or C2 to C4 alkenyl groups; R2 group is independently selected from C8 to C28 alkyl or alkenyl groups, and $X^-$ is as defined above.

Silicones and their chemistry are described in, for example in The Encyclopaedia of Polymer Science, volume 11, p765.

Silicones suitable for the present invention are fabric softening silicones. Non-limiting examples of such silicones include:

- Non-functionalised silicones such as polydimethylsiloxane (PDMS),
- Functionalised silicones such as alkyl (or alkoxy) functionalised, alkylene oxide functionalised, amino functionalised, phenyl functionalised, hydroxy functionalised, polyether functionalised, acrylate functionalised, siliconhydride functionalised, carboxy functionalised, phosphate functionalised, sulphate functionalised, phosphonate functionalised, sulphonic functionalised, betaine functionalised, quarternized nitrogen functionalised and mixtures thereof.
- Copolymers, graft co-polymers and block co-polymers with one or more different types of functional groups such as alkyl, alkylene oxide, amino, phenyl, hydroxy, polyether, acrylate, siliconhydride, carboxy, phosphate, sulphonic, phosphonate, betaine, quarternized nitrogen and mixtures thereof.

Suitable non-functionalised silicones have the general formula:

R1-Si(R3)2-O—[—Si(R3)2-O -]x-Si(R3)2-R2

- R1=hydrogen, methyl, methoxy, ethoxy, hydroxy, propoxy, and aryloxy group.
- R2=hydrogen, methyl, methoxy, ethoxy, hydroxy, propoxy, and aryloxy group.
- R3=alkyl, aryl, hydroxy, or hydroxyalkyl group, and mixtures thereof Suitable functionalised silicones may be anionic, cationic, or non-ionic functionalised silicones.

The functional group(s) on the functionalised silicones are preferably located in pendent positions on the silicone i.e. the composition comprises functionalised silicones wherein the functional group(s) are located in a position other than at the end of the silicone chain. The terms 'terminal position' and 'at the end of the silicone chain' are used to indicate the terminus of the silicone chain.

When the silicones are linear in nature, there are two ends to the silicone chain. In this case the anionic silicone preferably contains no functional groups located on a terminal position of the silicone. When the silicones are branched in nature, the terminal position is deemed to be the two ends of the longest linear silicone chain. Preferably no functional group(s) are located on the terminus of the longest linear silicone chain.

Preferred functionalised silicones are those that comprise the anionic group at a mid-chain position on the silicone. Preferably the functional group(s) of the functionalised silicone are located at least five Si atoms from a terminal position on the silicone. Preferably the functional groups are distributed randomly along the silicone chain.

For best performance, it is preferred that the silicone is selected from: carboxy functionalised silicone; anionic functionalised silicone; non-functionalised silicone; and mixtures thereof. More preferably, the silicone is selected from: carboxy functionalised silicone; amino functionalised silicone; polydimethylsiloxane (PDMS) and mixtures thereof. Preferred features of each of these materials are outlined herein. Most preferably the silicone is selected from amino functionalised silicones; polydimethylsiloxane (PDMS) and mixtures thereof.

Malodour Ingredient

In addition to the prebiotic, the compositions of the present invention may comprise a further malodour ingredient. It is believed that additional malodour ingredients work synergistically in the reduction of malodours or the prevention of malodours. In the context of the present invention, free perfumes are not considered malodour ingredients.

Anti-malodour agent may be present at a level selected from: less than 20%, less than 10%, and less than 5%, by weight of the spray composition. Suitably anti-malodour agent is present in the spray composition in an amount selected from the range of from about 0.01% to about 5%, preferably from about 0.1% to about 3%, more preferably from about 0.5% to about 2%, by weight of the spray composition.

Any suitable anti-malodour agent may be used. Indeed, an anti-malodour effect may be achieved by any compound or product that is effective to "trap", "absorb" or "destroy" odour molecules to thereby separate or remove odour from the garment or act as a "malodour counteractant".

The odour control agent may be selected from the group consisting of: uncomplexed cyclodextrin, odour blockers, reactive aldehydes, flavonoids, zeolites, activated carbon, a mixture of zinc ricinoleate or a solution thereof, a substituted monocyclic organic compound and mixtures thereof.

A suitable anti-malodour agent is cyclodextrin, suitably water soluble uncomplexed cyclodextrin. Suitably cyclodextrin is present at a level selected from 0.01% to 5%, 0.1% to 4%, and 0.5% to 2% by weight of the spray composition.

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings.

Preferably, the cyclodextrins are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a —CH2-CH(OH)—CH3 or a —CH2CH2-OH group; branched cyclodextrins such as maltose-bonded cyclodextrins; cationic cyclodextrins such as those containing 2-hydroxy-3-(dimethylamino)propyl ether, wherein R is CH2-CH(OH)—CH2-N(CH3)2 which is cationic at low pH; quaternary ammonium, e.g., 2-hydroxy-3-(trimethylammonio)propyl ether chloride groups, wherein R is CH2-CH(OH)—CH2-N+(CH3)3C1-; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrinse.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odour control performance. Solubilized, water-soluble cyclodextrin can exhibit more efficient odour control performance than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar U.S.A., Inc. and Wacker Chemicals (U.S.A.), Inc.

In embodiments mixtures of cyclodextrins are used.

"Odour blockers" can be used as an anti-malodour agent to mitigate the effects of malodours. Non-limiting examples of odour blockers include 4-cyclohexyl-4-methyl-2-pentanone, 4-ethylcyclohexyl methyl ketone, 4-isopropylcyclohexyl methyl ketone, cyclohexyl methyl ketone, 3-methylcyclohexyl methyl ketone, 4-tert.-butylcyclohexyl methyl ketone, 2-methyl-4-tert.butylcyclohexyl methyl ketone, 2-methyl-5-isopropylcyclohexyl methyl ketone, 4-methylcyclohexyl isopropyl ketone, 4-methylcyclohexyl secbutyl ketone, 4-methylcyclohexyl isobutyl ketone, 2,4-dimethylcyclohexyl methyl ketone, 2,3-dimethylcyclohexyl methyl ketone, 2,2-dimethylcyclohexyl methyl ketone, 3,3-dimethylcyclohexyl methyl ketone, 4,4-dimethylcyclohexyl methyl ketone, 3,3,5-trimethylcyclohexyl methyl ketone, 2,2,6-trimethylcyclohexyl methyl ketone, 1-cyclohexyl-1-ethyl formate, 1-cyclohexyl-1-ethyl acetate, 1-cyclohexyl-1-ethyl propionate, 1-cyclohexyl-1-ethyl isobutyrate, 1-cyclohexyl-1-ethyl n-butyrate, 1-cyclohexyl-1-propyl acetate, 1-cyclohexyl-1-propyl n-butyrate, 1-cyclohexyl-2-methyl-1-propyl acetate, 2-cyclohexyl-2-propyl acetate, 2-cyclohexyl-2-propyl propionate, 2-cyc10hexyl-2-propyl isobutyrate, 2-cyc10hexyl-2-propyl nbutyrate, 5,5-dimethyl-1,3-cyclohexanedione (dimedone), 2,2-dimethyl-1,3-dioxane-4,6-dione (Meldrum's acid), spiro-[4.5]-6,10-dioxa-7,9-dioxodecane, spiro-[5.5]-1,5-dioxa-2,4-dioxoundecane, 2,2-hydroxymethyl-1,3-dioxane-4,6-dione and 1,3-cyclohexadione. Odour blockers are disclosed in more detail in U.S. Pat. Nos. 4,009,253; 4,187,251; 4,719,105; 5,441,727; and 5,861,371, incorporated herein by reference.

Reactive aldehydes can be used as anti-malodour agent to mitigate the effects of malodours. Examples of suitable reactive aldehydes include Class I aldehydes and Class II aldehydes. Examples of Class I aldehydes include anisic aldehyde, o-allyl-vanillin, benzaldehyde, cuminic aldehyde, ethylaubepin, ethyl-vanillin, heliotropin, tolyl aldehyde, and vanillin. Examples of Class II aldehydes include 3-(4'-tert.butylphenyl)propanal, 2-methyl-3-(4'-tertbutylphenyl)propanal, 2-methyl-3-(4'-isopropylphenyl)propanal, 2,2-dimethyl-3-(4-ethylphenyl)propanal, cinnamic aldehyde, a-amyl-cinnamic aldehyde, and a-hexyl-cinnamic aldehyde. These reactive aldehydes are described in more detail in U.S. Pat. No. 5,676,163. Reactive aldehydes, when used, can include a combination of at least two aldehydes, with one aldehyde being selected from acyclic aliphatic aldehydes, non-terpenic aliphatic aldehydes, non-terpenic alicyclic aldehydes, terpenic aldehydes, aliphatic aldehydes substituted by an aromatic group and bifunctional aldehydes; and the second aldehyde being selected from aldehydes possessing an unsaturation alpha to the aldehyde function conjugated with an aromatic ring, and aldehydes in which the aldehyde group is on an aromatic ring. This combination of at least two aldehydes is described in more detail in WO 00/49120. As used herein, the term "reactive aldehydes" further encompasses deodourizing materials that are the reaction products of (i) an aldehyde with an alcohol, (ii) a ketone with an alcohol, or (iii) an aldehyde with the same or different aldehydes. Such deodourizing materials can be: (a) an acetal or hemiacetal produced by means of reacting an aldehyde with a carbinol; (b) a ketal or hemiketal produced by means of reacting a ketone with a carbinol; (c) a cyclic triacetal or a mixed cyclic triacetal of at least two aldehydes, or a mixture of any of these acetals, hemiacetals, ketals, hemiketals, or cyclic triacetals. These deodorizing perfume materials are described in more detail in WO 01/07095 incorporated herein by reference.

Flavanoids can also be used as anti-malodour agent. Flavanoids are compounds based on the C6-C3-C6 flavan skeleton. Flavanoids can be found in typical essential oils. Such oils include essential oil extracted by dry distillation from needle leaf trees and grasses such as cedar, Japanese cypress, eucalyptus, Japanese red pine, dandelion, low striped bamboo and cranesbill and can contain terpenic material such as alpha-pinene, beta-pinene, myrcene, phencone and camphene. Also included are extracts from tea leaf. Descriptions of such materials can be found in JP 02284997 and JP 04030855 incorporated herein by reference.

Metallic salts can also be used as anti-malodour agents for malodour control benefits. Examples include metal salts of fatty acids. Ricinoleic acid is a preferred fatty acid. Zinc salt is a preferred metal salt. The zinc salt of ricinoleic acid is especially preferred. A commercially available product is TEGO Sorb A30 ex Evonik. Further details of suitable metallic salts is provided below.

Zeolites can be used as anti-malodour agent. A useful class of zeolites is characterized as "intermediate" silicate/aluminate zeolites. The intermediate zeolites are characterized by SiO2/AlO2 molar ratios of less than about 10. Preferably the molar ratio of SiO2/AlO2 ranges from about 2 to about 10. The intermediate zeolites can have an advantage over the "high" zeolites. The intermediate zeolites have a higher affinity for amine-type odours, they are more weight efficient for odour absorption because they have a larger surface area, and they are more moisture tolerant and retain more of their odour absorbing capacity in water than the high zeolites. A wide variety of intermediate zeolites suitable for use herein are commercially available as Valfor® CP301-68, Valfor® 300-63, Valfor® CP300-35, and Valfor® CP300-56, available from PQ Corporation, and the CBV100@series of zeolites from Conteka. Zeolite materials marketed under the trade name Abscents® and Smellrite®, available from The Union Carbide Corporation and UOP are also preferred. Such materials are preferred over the intermediate zeolites for control of sulfur-containing odours, e.g., thiols, mercaptans. Suitably the zeolite material has a particle size of less than about 10 microns and is present in the spray composition at a level of less than about 1% by weight of the spray composition.

Activated carbon is another suitable anti-malodour agent. Suitable carbon material is a known absorbent for organic molecules and/or for air purification purposes. Often, such carbon material is referred to as "activated" carbon or "activated" charcoal. Such carbon is available from commercial sources under such trade names as; Calgon-Type CPG®;Type PCB®;Type SGL®;Type CAL®;and Type OL®. Suitably the activated carbon preferably has a particle size of less than about 10 microns and is present in the spray composition at a level of less than about 1% by weight of the spray composition.

Exemplar anti-malodour agents are as follows.

ODOBAN™ is manufactured and distributed by Clean Central Corp. of Warner Robins, Ga. Its active ingredient is alkyl (C14 50%, C12 40% and C16 10%) dimethyl benzyl ammonium chloride which is an antibacterial quaternary ammonium compound. The alkyl dimethyl benzyl ammonium chloride is in a solution with water and isopropanol. Another product by Clean Control Corp. is BIOODOUR CONTROL™ which includes water, bacterial spores, alkylphenol ethoxylate and propylene glycol.

ZEOCRYSTAL FRESH AIR MIST™ is manufactured and distributed by Zeo Crystal Corp. (a/k/a American Zeolite Corporation) of Crestwood, III. The liquid comprises chlorites, oxygen, sodium, carbonates and citrus extract, and may comprise zeolite.

The odour control agent may comprise a "malodour counteractant" as described in US2005/0113282A1 by which is hereby incorporated by reference. In particular this malodour counteractant may comprise a mixture of zinc ricinoleate or a solution thereof and a substituted monocyclic organic compound as described at page 2, paragraph 17 whereby the substituted monocyclic organic compound is in the alternative or in combination one or more of:

1-cyclohexylethan-1-yl butyrate;

1-cyclohexylethan-1-yl acetate;

1-cyclohexylethan-1-ol;

1-(4'-methylethyl) cyclohexylethan-1-yl propionate; and

2'-hydroxy-1'-ethyl(2-phenoxy)acetate.

Synergistic combinations of malodour counteractants are suitable, for example, the compositions comprising:

(i) from about 10 to about 90 parts by weight of at least one substituted monocyclic organic compound-containing material which is:

(a) 1-cyclohexylethan-1-yl butyrate having the structure:

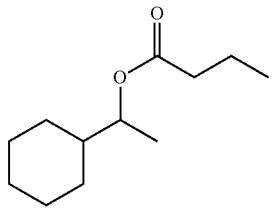

(b) 1-cyclohexylethan-1-yl acetate having the structure:

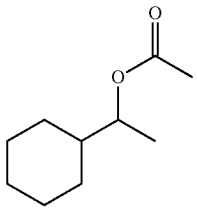

(c) 1-cyclohexylethan-1-ol having the structure:

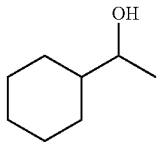

(d) 1-(4'-methylethyl)cyclohexylethan-1-yl propionate having the structure:

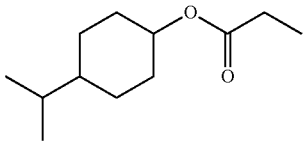

and (e) 2'-hydroxy-1'-ethyl(2-phenoxy)acetate having the structure:

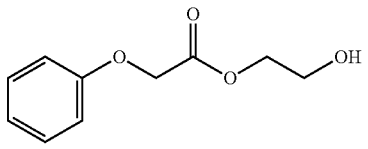

and (ii) from about 90 to about 10 parts by weight of a zinc ricinoleate-containing composition which is zinc ricinoleate and/or solutions of zinc ricinoleate containing greater than about 30% by weight of zinc ricinoleate. Preferably, the aforementioned zinc ricinoleate-containing compositions are mixtures of about 50% by weight of zinc ricinoleate and about 50% by weight of at least one 1-hydroxy-2-ethoxyethyl ether of a More specifically, a preferred composition useful in combination with the zinc ricinoleate component is a mixture of:

(A) 1-cyclohexylethan-1-yl butyrate;

(B) 1-cyclohexylethan-1-yl acetate; and (C) 1-(4'-methylethyl)cyclohexylethan-1-yl propionate.

More preferably, the weight ratio of components of the immediately-aforementioned zinc riconoleate-containing mixture is one where the zinc ricinoleate-containing composition: 1-cyclohexylethan-1-yl butyrate: 1-cyclohexylethan-1-yl acetate: 1-(4'-methylethyl)-cyclohexylethan-1-yl propionate is about 2:1:1:1.

Another preferred composition useful in combination with the zinc ricinoleate component or solution is a mixture of:

(A) 1-cyclohexylethan-1-yl acetate; and (B) 1-(4'-methylethyl)cyclohexylethan-1-yl propionate.

More preferably, the weight ratio of components of the immediately-aforementioned zinc riconoleate mixture is one where the zinc ricinoleate-containing composition: 1-cyclohexylethan-1-yl acetate: 1-(4'-methylethyl)cyclohexylethan-1-yl propionate is about 3:1:1.

The anti-malodour materials of the present invention may be 'free' in the composition or they may be encapsulated. Suitable encapsulating material, may comprise, but are not limited to; aminoplasts, proteins, polyurethanes, polyacrylates, polymethacrylates, polysaccharides, polyamides, polyolefins, gums, silicones, lipids, modified cellulose, polyphosphate, polystyrene, polyesters or combinations thereof. Particularly preferred encapsulating materials are aminoplasts, such as melamine formaldehyde or urea formaldehyde. The microcapsules of the present invention can be friable microcapsules and/or moisture activated microcapsules. By friable, it is meant that the perfume microcapsule will rupture when a force is exerted. By moisture activated, it is meant that the perfume is released in the presence of water.

To the extent any material described herein as an odour control agent might also be classified as another component described herein, for purposes of the present invention, such material shall be classified as an odour control agent.

pH

The pH of the spray compositions of the present invention is preferably 2 to 12. This pH provides enhanced prebiotic activity.

Other Ingredients

Other optional ingredients may be present in the aqueous spray compositions of the present invention. For example the aqueous spray compositions may further comprise: colourants/dyes, preservatives, viscosity control agents, microcapsules comprising benefit agents, structurants/dispersants, solvents, antifoams for processing aid etc.

Spray Bottle

The compositions are fabric spray compositions. By this is meant that the compositions are suitable for spraying onto a fabric. They may be sprayed by any suitable spraying device.

Preferably the spray device is a manually operable spray device in the sense that the spray mechanism is manually operable to discharge a dose of said composition from the nozzle.

The spray mechanism may be operated by an actuator. The actuator can be a push actuator or a pull actuator. The actuator may comprise a trigger. The spray mechanism may comprise a hand-operable pump. Optionally, said pump is one of: a positive displacement pump; a self-priming pump; a reciprocating pump. Suitable spray devices include trigger sprays, continuous/semi-continuous sprays, finger pump sprays, vibrating mesh device output sprays.

Preferably the spray device is operable without the use of a propellant. Indeed, propellant-free spray devices are preferred. This allows the spray to maintain the integrity and purity of the product, uncontaminated with propellant and is preferably environmentally friendly.

Preferably the spray device is pressurised. This can improve spray duration and velocity. Preferably the spray device is pressurised by a gas chamber, separate from the reservoir containing the composition. The gas is preferably air or nitrogen. The spray device may comprise an outer container containing the composition and a pressurizing agent, wherein the composition is segregated from the pressurizing agent by containment (preferably hermetically sealed) in a flexible pouch. This which maintains complete formulation integrity so that only pure (i.e. excludes pressurising agent) composition is dispensed. Preferred systems are the so-called 'bag-in-can' (or BOV, bag-on-valve technology). Alternatively the spray device may comprise piston barrier mechanism, for example EarthSafe by Crown Holdings.

Preferably the spray device comprises a biodegradable plastic material.

The spray mechanism may further comprise an atomiser configured to break up said liquid dose into droplets and thereby facilitate creation of said fine aerosol in the form of a mist.

Conveniently, said atomiser may comprise at least one of: a swirl chamber and a lateral dispersion chamber. Suitably, the atomiser functions to mix air with the aqueous fabric spray composition.

The particle size of the formulation when sprayed is preferably no more than 300 μm, preferably no more than 250 μm, preferably no more than 150 μm, preferably no more than 125 μm, preferably no more than 100 μm. The particle size of the formulation when sprayed is preferably at least 5 μm, preferably at least 10 μm, preferably at least 15 μm, preferably at least 20 μm, preferably at least 30 μm, preferably at least 40 μm. Suitably the spray comprises droplets having an average diameter in the range of preferably 5 to 300 μm, more preferably 10 to 250 μm, most preferably 15 to 150 μm. This size allows for homogeneous distribution and a balance between sufficient wetting of the fabric, without potential fabric damage caused by excessive dosing of certain ingredients. Droplet size may be measured on a Malvern Spraytec instrument, with the peak maximum corresponding to the average droplet size. The parameter droplet size is the volume mean diameter, D[4,3].

Suitably, following actuation, the spray has a duration in the range of at least 0.4 seconds. Preferably the spray has a duration of at least 0.8 seconds. A longer duration minimises the effort by maximising coverage per actuation of a spray device. This is an important factor for products designed to be used over the full area of garments. Preferably the spray duration is directly linked to actuation such that the spray output continues only as long as the actuator is activated (e.g. as long as a button or trigger is pressed).

Spray reservoirs may be non-pressurised, manually or mechanically pre-pressurised devices. The above also to removable/refillable reservoirs.

According to a further aspect of the present invention, there is provided a replacement reservoir for a spray product according to the above aspect(s), the replacement reservoir being pre-filled with a volume of said spray composition for replenishment of said product. A suitable "refill kit" comprises one or more reservoirs. In the case of more than one reservoir, for example two, three, four, five, or more reservoirs, the contents (aqueous fabric spray composition) of each reservoir may the same as or different from the other reservoirs.

Dose

Conveniently, the spray composition is provided as a liquid, and said spray mechanism is operable to discharge a dose of at least 0.1 ml, preferably at least 0.2 ml, more preferably at least 0.25 ml, more preferably at least 0.3 ml, more preferably at least 0.35 ml, more preferably at least 0.35 ml, more preferably at least 0.4 ml, more preferably at least 0.45 ml, and most preferably at least 0.5 ml.

Suitably the dose is no more than 2 ml, preferably no more than 1.8 ml, preferably no more than 1.6 ml, more preferably no more than 1.5 ml, more preferably no more than 1.4 ml, more preferably no more than 1.3 ml, and most preferably no more than 1.2 ml.

Suitably the dose is between 0.1 and 2 ml of said liquid spray composition, preferably between 0.2 and 1.8 ml, more preferably 0.25 to 1.6 ml, more preferably 0.25 to 1.5 ml, and most preferably 0.25 to 1.2 ml.

These doses have been found to be particularly effective at achieving the desired garment refresh effect without unsightly and wasteful large droplet formation.

The dose may alternatively be defined as ml per m2 of fabric. Preferably the spray composition of the present invention is dosed as 0.1 to 20 ml per m2. More preferably 0.5 to 15 ml per m2 and most preferably 1 to 10 ml per m2.

Method of Use

N

In one aspect there is provided a method of malodour reduction or a method to prevent malodours from developing on a fabric surface. This is achieved by spraying the compositions as described herein on a fabric which has been worn for a period of time. In other words, this may be described as a method of reducing the frequency that a garment requires washing, allowing the consumer to wear the garment for longer before needing to wash.

Use

In one aspect there is provided a use of the composition as described herein. The composition may be used to provide malodour reduction to fabric or to prevent malodours from developing.

EXAMPLES

Example formulations:

| Functionality | Ingredient | A | 1 | 2 | 3 | 4 |
|---|---|---|---|---|---|---|
| Prebiotic | Pectin[1] | 0 | 0.5 | 0.5 | 1 | 0.5 |
| | Perfume | — | — | 0.2 | 0.2 | 1 |
| Emollient | Dicaprylyl ether[2] | 1.33 | 1.33 | 3 | — | 1 |
| | Hydrogenated Ethylhexyl Olivate (and) Hydrogenated Olive Oil Unsaponifiables[3] | 1.86 | 1.86 | — | 2.5 | 2 |
| Emulsifier | Hydrogenated castor oil[4] | 4 | 4 | 3 | 3 | 3 |
| Polymer | Polypeptides | — | — | — | — | 1 |
| Softening agent | Ester-quats | — | — | — | 0.5 | 0.5 |
| | Malodour ingredient | — | — | 0.02 | 0.02 | 0.1 |
| | Salt | 0.25 | 0.25 | 0.5 | 0.5 | 0.5 |
| | Water | To 100 | To 100 | | | |

Pectin[1]-ex. Sigma Aldrich

Dicaprylyl ether[2]-Cetiol OE ex BASF

Hydrogenated Ethylhexyl Olivate (and) Hydrogenated Olive Oil Unsaponifiables[3]-Plantasens Olive LD ex Clarient Hydrogenated castor oil[4]-Eumulgin CO 40 ex BASF Panel Test:

4 volunteers wore a saree blouse for 12 hours. The underarm area of each blouse was cut into two swatches, one was sprayed once with composition A and the other was sprayed once with composition 1. The swatches were aired overnight, then screened by a trained panel (18 hours after spraying). The mean scores recorded below.

| | Mean malodour score given by trained panel | |
|---|---|---|
| | Composition A | Composition 1 |
| Volunteer #1 mean score | 2.5 | 2.0 |
| Volunteer #2 mean score | 2.5 | 2.0 |
| Volunteer #3 mean score | 2.5 | 2.1 |
| Volunteer #4 mean score | 2.4 | 1.9 |

Swatches treated with composition 1, developed less malodour overnight than compositions treated with composition A.

Hydrogen Sulphide Test:

Hydrogen Sulphide gas is produced by bacteria when they are given any sources of sulphur, either L-cysteine hydrochloride, or L-cystine dihydrochloride. The production of hydrogen sulphide can be measured using lead acetate paper, which darkens on reaction with hydrogen sulphide to produce lead sulphide. The colour change can be quantified using L*a*b* values measured by a spectrometer.

4 volunteers wore a saree blouse for 12 hours. The underarm area of each blouse was cut into swatches, one was sprayed once with composition A and the other was sprayed once with composition 1. The swatches were then placed in wells of growth media (Tryptic Soyabean Casein Broth with 0.2% L-cysteine hydrochloride). Lead acetate paper was placed above the wells attached to the inside base of the lid. After 24 hours, the lead acetate paper was removed and the L*a*b* values where measured. Delta E was then calculated for each test lead acetate paper sample, by comparing the measured L*a*b* values with the L*a*b* values of unused (control) lead acetate paper, using the formula:

$$\Delta E^*_{ab} = \sqrt{(L^*_2 - L^*_1) + (a^*_2 - a^*_1) + (b^*_2 - b^*_1)^2}$$

Wherein:

$L^*_2$, $a^*_2$ and $b^*_2$ are the values for test lead acetate paper $L^*_1$, $a^*_1$ and $b^*_1$ are the values for control lead acetate paper

| | Composition A | Composition 1 |
|---|---|---|
| Delta E values from a white control | 24 | 18 |

A lower delta E means that the lead acetate paper was lighter, which means that it reacted with less hydrogen sulphide, indicating lower levels of malodour.

The invention claimed is:

1. A method of malodour reduction, the method comprising:

spraying a fabric including a malodour with a composition comprising:

a prebiotic, wherein the prebiotic is lactitol, a perfume, an emollient, and water.

2. A method of preventing malodours from developing on a fabric surface, the method comprising:

spraying the fabric with a composition comprising:

a prebiotic, wherein the prebiotic is lactitol, a perfume, an emollient, and water.

3. The method of malodour reduction of claim 1, wherein the composition further comprises an emulsifier.

4. The method of malodour reduction of claim 1, wherein the composition further comprises additional polymer(s).

5. The method of malodour reduction of claim 4, wherein the polymer is a natural polymer.

6. The method of malodour reduction of claim 1, wherein the composition further comprises a softening agent.

7. The method of malodour reduction of claim 1, wherein the composition further comprises additional malodour ingredients.

8. The method of preventing malodours from developing on a fabric surface of claim 2, wherein the composition further comprises an emulsifier.

9. The method of preventing malodours from developing on a fabric surface of claim 2, wherein the composition further comprises additional polymer(s).

10. The method of preventing malodours from developing on a fabric surface of claim 2, wherein the composition further comprises a softening agent.

11. The method of preventing malodours from developing on a fabric surface of claim 2, wherein the composition further comprises additional malodour ingredients.

* * * * *